United States Patent [19]

Lüthi

[11] 4,010,599

[45] Mar. 8, 1977

[54] PROCESS AND APPARATUS FOR TEXTURING TEXTILE YARNS OF THERMOPLASTIC MATERIAL BY IMPARTING TWIST BY FRICTION

[75] Inventor: Walter Lüthi, Ebnat-Kappel, Switzerland

[73] Assignee: Heberlein Maschinenfabrik AG, Wattwil, Switzerland

[22] Filed: June 9, 1976

[21] Appl. No.: 694,437

[30] Foreign Application Priority Data

June 16, 1975 Switzerland ..... 7798/75
Feb. 25, 1976 Switzerland ..... 2350/76

[52] U.S. Cl. ..... 57/34 HS; 57/77.4; 57/157 TS

[51] Int. Cl.[2] ..... D01H 7/92; D01H 13/04; D02G 1/04

[58] Field of Search ..... 57/34 R, 34 HS, 77.3, 57/77.4, 77.45, 157 R, 157 TS, 157 MS, 106

[56] References Cited

UNITED STATES PATENTS

| | | | |
|---|---|---|---|
| 3,287,890 | 11/1966 | McIntosh et al. | 57/77.4 |
| 3,296,786 | 1/1967 | Wyatt | 57/34 HS |
| 3,327,463 | 6/1967 | Niina et al. | 57/77.4 |

*Primary Examiner*—Donald Watkins
*Attorney, Agent, or Firm*—Larson, Taylor and Hinds

[57] ABSTRACT

Apparatus and a process for texturing textile yarn of thermoplastic material are described wherein the yarn is fed through input guide means including a yarn tension sensing unit to the surface of a continuously rotating cylinder having equidistantly spaced annular grooves distributed along its length with an annular friction surface between each pair of adjacent grooves. A series of rod-shaped thread guides, one for each groove, project from a support element into the grooves at points located on a notional helical curve extending along the cylinder. Thus, the yarn is constrained to travel along a helical path in contact with at least a portion of the series of thread guides while in contact with rotating annular surfaces. The yarn leaves the cylinder by way of output guide means including a yarn tension sensing unit. The angle between the direction of movement of the surface of the rotating cylinder and the direction of movement of the yarn along the helical path is a constant, the angle being larger than the twist angle imparted to the yarn. The input and output tension sensing units may mechanically provide an indication of the ratio of these tensions enabling the ratio to be adjusted if it departs from a predetermined value, usually unity. Alternatively, these units may be electrical and control a servo motor that provides the required adjustment by moving an input thread guide for the yarn. This thread guide may be mounted on a member mounted on a plate to rotate about the cylinder and series of rod-shaped thread guides that extend through a hole in a plate. The servo motor moves the plate along the axis of the cylinder while a cam interaction between the rotatable member and the support for the series of thread guides causes the input thread guide to move parallel to the helical curve. When starting, the plate can first be moved to or close to the output end of the cylinder to reduce yarn tension.

20 Claims, 7 Drawing Figures

PROCESS AND APPARATUS FOR TEXTURING TEXTILE YARNS OF THERMOPLASTIC MATERIAL BY IMPARTING TWIST BY FRICTION

FIELD OF THE INVENTION

This invention relates to apparatus and a process for texturing textile yarns of thermoplastic material by imparting, by means of friction, false twist to the yarn.

In the manufacture of textured yarns according to the false-twisting process, various kinds of friction twist imparters are used. In most types of these twist imparters, the desired twist density cannot be controlled directly, but only after considerable experimental work. Furthermore, the twist density during operation of the machine is subject to considerable variations which are due to variation of the friction coefficient, of yarn tension and of other factors. Furthermore, in most friction twist imparters, the yarn tension downstream of the twist imparter (i.e. the output tension) is essentially higher than the tension upstream of the twist imparter (i.e. the input tension).

DESCRIPTION OF THE PRIOR ART

In Swiss patent specification No. 560,258, for example, a process is described according to which the yarn is caused to move across a moving surface at an angle which is at least approximately equal to the desired twist angle to be imparted to the yarn. It is suggested in this specification to control the twist density by first determining the twist angle of the yarn and the surface speed resulting therefrom by calculation or by experiments and then adjusting the twist imparter so that the angle which the yarn forms with the direction of movement of the moving surface is identical with the twist angle and so that the speed of the moving surface is equal with the resulting speed of the yarn surface.

These measures are to lead to the effect that the yarn moves over the moving surface with essentially slippage-free, rotating movement. The achievement of this condition should be recognized from the fact that the output tension is low which obviously means that it is approximately equal with the input tension. However, no device for measuring the output speed is provided, and it is not shown how the imparted torsional moment can be altered if the output tension is not low.

It is furthermore a fact that the described rotating, slippage-free running of the yarn is not desirable since, thereby, the friction force between the yarn and the twist imparter is not determined which causes unstable running of the yarn.

Furthermore, the known device has the disadvantage that, for each change of the twist density, the geometry of the twist imparter must be changed and that the desired angle between the directions of movement of the yarn and of the twist imparter partially depends on the friction force and is therefore not defined exactly enough. Furthermore, the surface speed of the twist imparters varies along the yarn path.

SUMMARY OF THE INVENTION

It is the purpose of the present invention to eliminate the above-mentioned disadvantages and to provide a process and an apparatus for friction false-twisting of textile yarns which, while treating the yarns with care, assure stable movement and constant twist density of the yarn, the twist density slide modifiable without changing the geometry of the twist imparter.

The object of the present invention is accordingly, a process for texturing textile yarns of thermoplastic material by imparting friction false-twist, the yarn moving across the outer surface of a rotating twist imparter at an angle with respect to its direction of movement, which is characterized in that the yarn moves over the surface of the twist imparter in a helical path, the angle between the direction of movement of the twist imparter and the direction of movement of the yarn being constant over the whole surface of the twist imparter and bigger than the twist angle of the yarn and in that the tension of the yarn upon input into the twist imparter and the tension upon ouput from the same being compared with each other and automatically brought approximately to the same value.

The present invention also relates to an apparatus for the process of the present invention, comprising, as twist imparter, a cylinder rotating around its own axis, which is characterized in that the cylinder surface is provided with friction surfaces extending transversely with respect to the cylinder axis at determined distances from each other and with grooves therebetween, in that, furthermore, a support element is arranged around the cylinder, comprising rod-shaped thread-guides extending radially with respect to the cylinder, the free ends of which engage with the grooves, the connection line between the points of engagement of the thread-guides with the grooves forming a helical curve and in that there is provided a tension compensating device which is under the influence of yarn tension at the input into the twist imparter and of the yarn tension at the output therefrom.

The yarn may be wrapped around the whole friction cylinder from the beginning so that the wrap angle is approximately 200°–300° . If the texturing machine is started in this condition, this can lead to a high twisting-in speed of the yarn and therefore to temporary overtension of the yarn which, in thin yarns, may cause thread breakages. Furthermore, threading of the yarn into the apparatus may be rather lengthy since the yarn must be threaded manually over the whole length of the friction cylinder. Furthermore, the control range of twist density is somewhat limited.

The present invention therefore includes a further development designed to eliminate these disadvantages.

According also to the invention, therefore, wrapping of the friction cylinder surface by the yarn is adjusted to the value necessary for the desired twist density by means of a thread-guide movable in the direction of the cylinder axis and about the cylinder circumference. In this case, wrapping of the friction cylinder may be brought, starting with a value of between 0 and 20% of total wrapping, to the value necessary for the desired twist density. Furthermore, the revolution speed of the friction cylinder can be chosen so that the ratio between yarn tension on the movable thread-guide and the tension of the yarn when leaving the friction cylinder has a predetermined value in the presence of the desired twist density in the yarn, which ratio is at least approximately 1 : 1. Furthermore, the ratio of the yarn tensions may be measured continuously, and each deviation of the ratio from the predetermined value may be brought back to the predetermined value by modifying the wrapping of the yarn around the cylinder.

The apparatus for this process may then comprise a device for controlling the wrapping of the yarn around the friction cylinder, consisting of a thread-guide situated at the yarn input end of the friction cylinder and movable in the direction of the cylinder axis and of the cylinder circumference, of a stationary thread-guide situated at the yarn output end of the friction cylinder and of a tension measuring device associated with each thread-guide.

DESCRIPTION OF THE DRAWINGS

The present invention will hereinafter be described in more detail with reference to the examples shown in the accompanying drawings, wherein.

Figure 1:
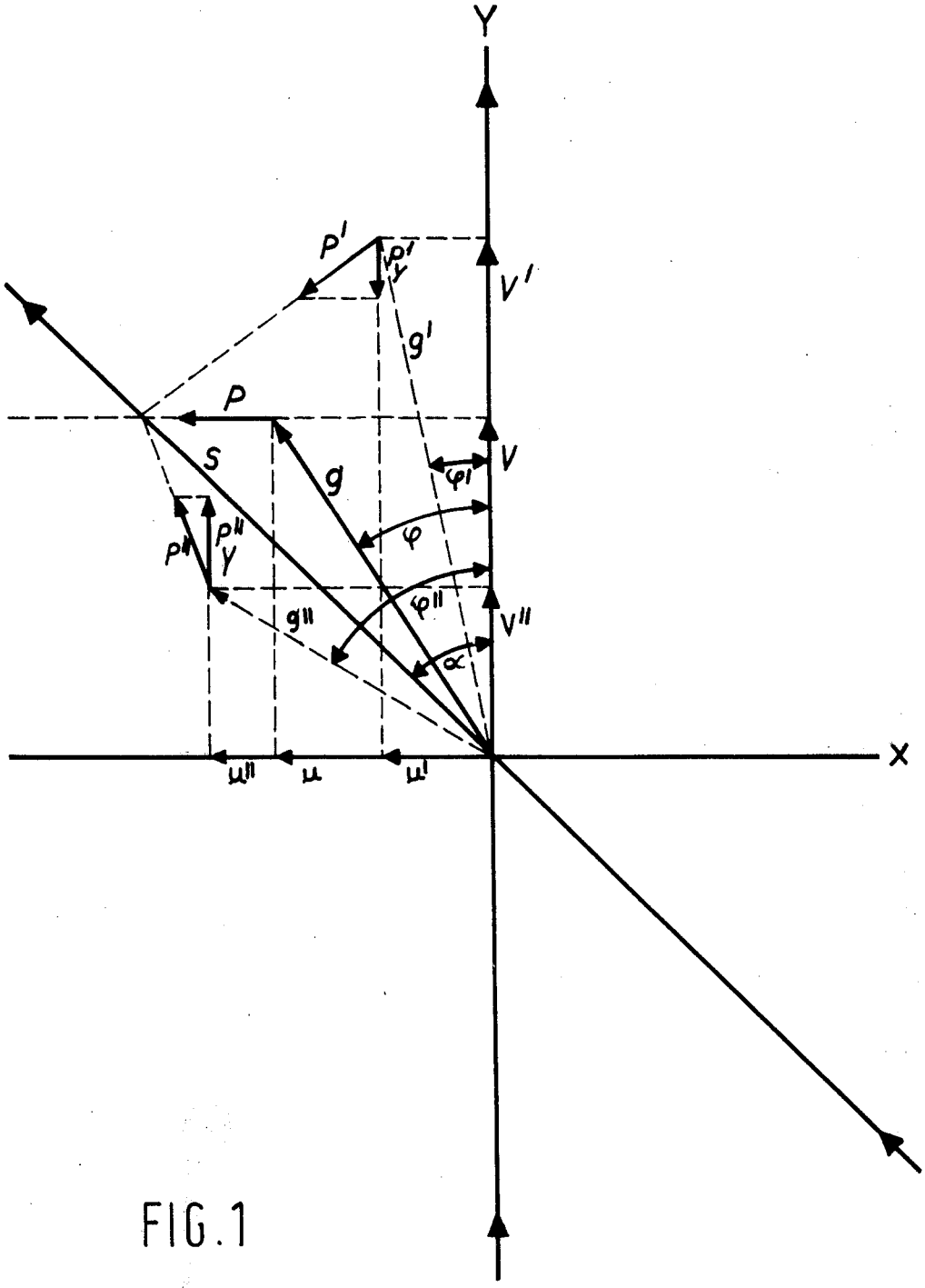
FIG. 1 is a vector diagram showing the kinematic principles of friction twist imparters.

The mechanical and geometrical principles of a friction twist imparter are schematically shown vectorially in FIG. 1. The yarn moves in the Y direction with a speed v and has a circumferential speed $u$ in the X direction which is imparted to the yarn by the twist imparter. At a determined speed $v_o$ of the non-twisted yarn upstream of the processing zone, the values $u$ and $v$ depend on the twist density of the yarn in the sense that $v$ decreases with increasing twist density whereas $u$ increases twist density.

For a predetermined twist density, the values of $u$ and $v$depend to a certain degree on the yarn tension, but, in the practical tension range, this effect can be neglected, and it is therefore approximately correct to state that a certain value of $u$ and a certain value of $v$correspond to a determined twist density. From the speeds $u$ and $v$, there results a resultant speed $g$ of the yarn surface the direction of which is inclined with respect to the direction of yarn movement by twist angle $\phi$ .

If now the direction of movement of the twist imparter is inclined by an angle $\alpha$ with respect to the direction of movement of the yarn and if the twist imparter moves at a speed $s$, the value of $u$ can never be bigger than the component of $s$ in the X direction because the yarn cannot be faster than the twist imparter in this direction. There results therefrom the condition:

$$u < s \sin\alpha$$

The real value of $u$ and therefore the real value of twist density depends on the torsional moment which the twist imparter imparts to the yarn. Therefore, all three values of $u$ ($u$, $u'$, $u''$) shown in FIG. 1 are possible. To each of these values of $u$, there corresponds a value of $v$ ($v$, $v'$, $v''$), the value of $v$ being greater or smaller than the speed component of the twist imparter in the Y direction (scos $\alpha$) or having the same value as scos $\alpha$. If, for example, $v$ has the value of $v' >$ scos $\alpha$, then the friction force P′ between twist imparter and yarn has a component $P'_y$, which acts against the direction of movement of the yarn and causes the output tension to be higher than the input tension. If, however, $v$ has the value of $v'' <$ scos $\alpha$, then the friction force P″ has a component $P''_y$, which causes the output tension to be lower than the input tension. In the limiting case, where $v =$ scos $\alpha$, the friction force P has no component in the Y direction, and the output tension equals the input tension.

The principle of imparting twist according to the process of the present invention is shown in FIG. 1. The angle $\alpha$ is chosen so that, even with the highest twist densities used in practice, it is essentially larger than the twist angle $\phi$. Thereby, it is assured that, with all twist densities, a certain, but not too large slippage occurs between yarn and twist imparter, whereby the direction of friction force is exactly defined and the stability of movement assured.

If it is desired to adjust the twist imparter to a determined twist density, only the value $v$ must be known which corresponds to this twist density. This value can be determined easily and exactly by experiment and difficult and inexact measurements of the twist angle $\phi$ or of yarn radius are unnecessary. After the value $v$ has been determined, the speed of the twist imparter is adjusted so that it corresponds to the following condition.

$$s \cos \alpha = v$$

If, now the yarn has the desired twist density, i.e. the correct speed of movement $v$, the friction force P acts in the X direction and has no component in the Y direction. This is shown by the fact that the output speed equals the input speed.

If the twist density is too low, the friction force, as already explained above, causes the tension to increase and, if the twist density is too high, it causes the tension to decrease. In carrying out the present invention, the input and output tensions are compared with each other by a tension measuring scale and, if the two tensions are not equal, the twist density is corrected, according to necessity, by increasing or reducing the torsional moment applied to the yarn.

A process in accordance with the invention will now be described in more detail with reference to the apparatus shown in FIGS. 2 and 3. The twist imparter consists of a horizontal cylinder 1 which is driven by a belt 2 and rotates in the direction of arrow B. The portion of cylinder 1 which is in contact with the belt 2 has a smooth surface. The remaining surface of the cylinder is covered at spaced intervals with annular friction surfaces 3 arranged at uniform distances from each other, which advantageously consist of polyurethane. Between the friction surfaces, there are a number of annular grooves 4. A helical support element 6 extends around the cylinder, which carries a row of thread-guides 5. The thread-guides 5 consist of pins which are disposed radially with respect to the cylinder and respectively project into the grooves 4. The points at which the pins 5 enter the grooves are arranged in a helical curve which has an inclination angle $\alpha$ with respect to the grooves. This angle corresponds to the angle $\alpha$ in FIG. 1 and advantageously is 60°.

The yarn 7 coming from the processing zone (not shown) moves towards the cylinder surface over roller 8 and through thread-guide 9. It then moves around cylinder 1 along a helical path which is fixed by the thread-guides 5 and then reaches delivery rollers (not shown) after passing over deviation rollers 16, 17, 12 and 18. The thread-guide 9 is fixed on rod 10 which passes through a radial bore in shaft 11 and can be fixed in position on shaft 11 by set screw 22. The rod 10 and therefore also the thread-guide 9 are therefore adjustable vertically. The shaft 11 is fixed on lever 13 which is fixed on shaft 14 supported for rotation in the machine frame portion 21. At the other end of shaft 14, there is provided a pointer 15 which can move between abutments 19 and 20. The roller 12 is supported for rotation on shaft 11.

The cylinder 1 is approximately 20 cm long and has a diameter of 4 cm. The projection of the yarn wrapped around the twist imparter is approximately 400°, and thereby, the real wrap angle is approximately 200°. The latter is determined by the position of the thread-guide 9 and is therefore adjustable. If, for example, the thread-guide is in the position 9' (FIG. 3) shown by dashed lines, then, the yarn 7' which is also shown in dashed lines, reaches the twist imparter in another place whereby the wrap angle is increased.

If the machine is in operation, the yarn is moved towards the pins 5 by friction contact with the coatings 3, the distance between the pins being approximately 1 cm so that the deflection of the yarn between the pins is very small and so that the real path of the yarn is nowhere different from the helical path which is determined by the thread-guide 5 by more than ± 3°. From the cylindrical shape of the twist imparter, it also results that the surface speed of the twist imparter along the whole twist imparter surface is the same. By these arrangements, the mechanics and the geometry of the twist imparter and of the yarn are defined in a simple and exact manner and can, therefore, be controlled easily.

In order to impart to the yarn a determined twist density, it is at first necessary to know the speed $v$ which corresponds to this twist density. Thereupon, the revolution speed of the twist imparter is adjusted so that its circumferential speed $s$ equals $v/\cos\alpha$. It is then checked by means of the tension compensation device the function of which is shown in FIG. 3 if the yarn now indeed has the desired twist density. In this figure, the twist imparter is shown in partial cross-section A—A (FIG. 2) along the helical yarn path. For simplicity's sake, also the rollers 16, 17 are only shown as one roller.

Figure 3:
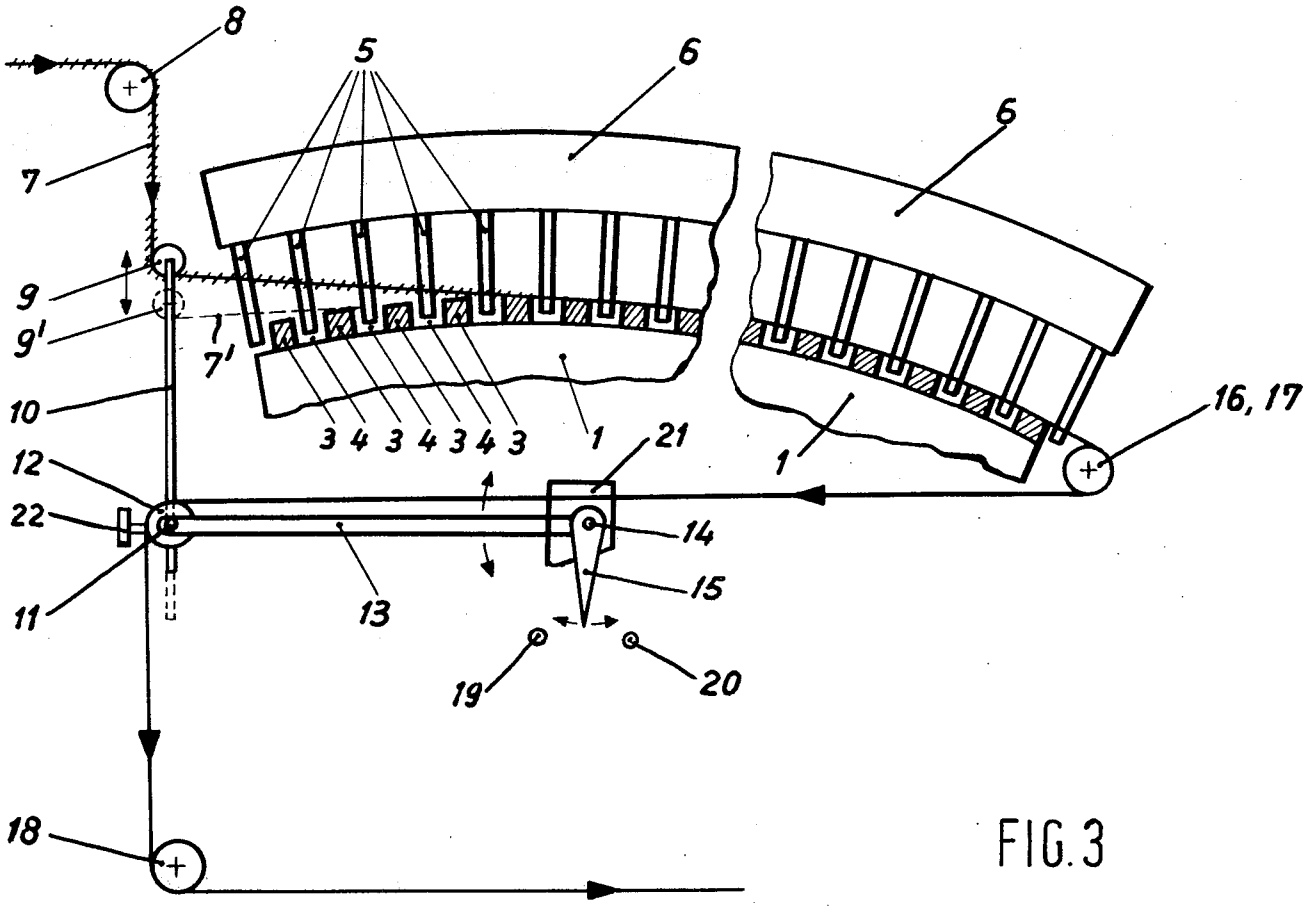
FIG. 3 shows schematically a front elevation of the apparatus of FIG. 2, partially in section along line A — A in FIG. 2.

FIG. 3 shows that the lever 13 is, as high. as being under the influence of the input tension which acts on the thread-guide 9 and on the shaft 11, also under the influence of the output tension which acts on roller 12 and on shaft 11. If the input tension is lower than the output tension, the latter moves the lever 13 downwards and thereby presses the pointer 15 against the abutment 20. If the input tension is higher than the output tension, the pointer is pressed against abutment 19. In the first case, the twist density is too low, and in the latter case, it is too high, Only if the twist density has the preselected value, the pointer 15 is free from the two abutments 19, 20 because, then, the two tensions are equal.

If it is for example found that, during the starting phase, the pointer 15 is continuously pressed against abutment 20 and thereby shows that the twist density is too low, then the wrap angle of the yarn around the twist imparter must be increased so as to increase the torsional moment imparted to the yarn. This is effected by first maintaining the pointer in its middle position and then lowering the rod 10 and the thread-guide 9 by loosening the set screw 22 on shaft 11 until the pointer, when released, remains freely in the middle position. The twist density then has the desired value. If, during operation of the machine, the twist density starts to differ from its desired value, this is compensated automatically since, for example in case of too low twist density, the thread-guide 9 is lowered and the wrap angle increased thereby. By this arrangement, it is possible to keep the imparted torsional moment in the desired range and thereby to avoid excessive strain on the yarn.

Automatic control of twist density in the described manner can only take place in a certain range of wrap angles. If it becomes apparent during operation of the machine that this range is insufficient, the pointer 15 is pressed against one of the two abutments 19, 20. A safety device can thereupon be operated which to stop the machine or to illuminate a light to warm personnel manually to correct the twist density by adjusting the thread-guide 9.

Figure 4:
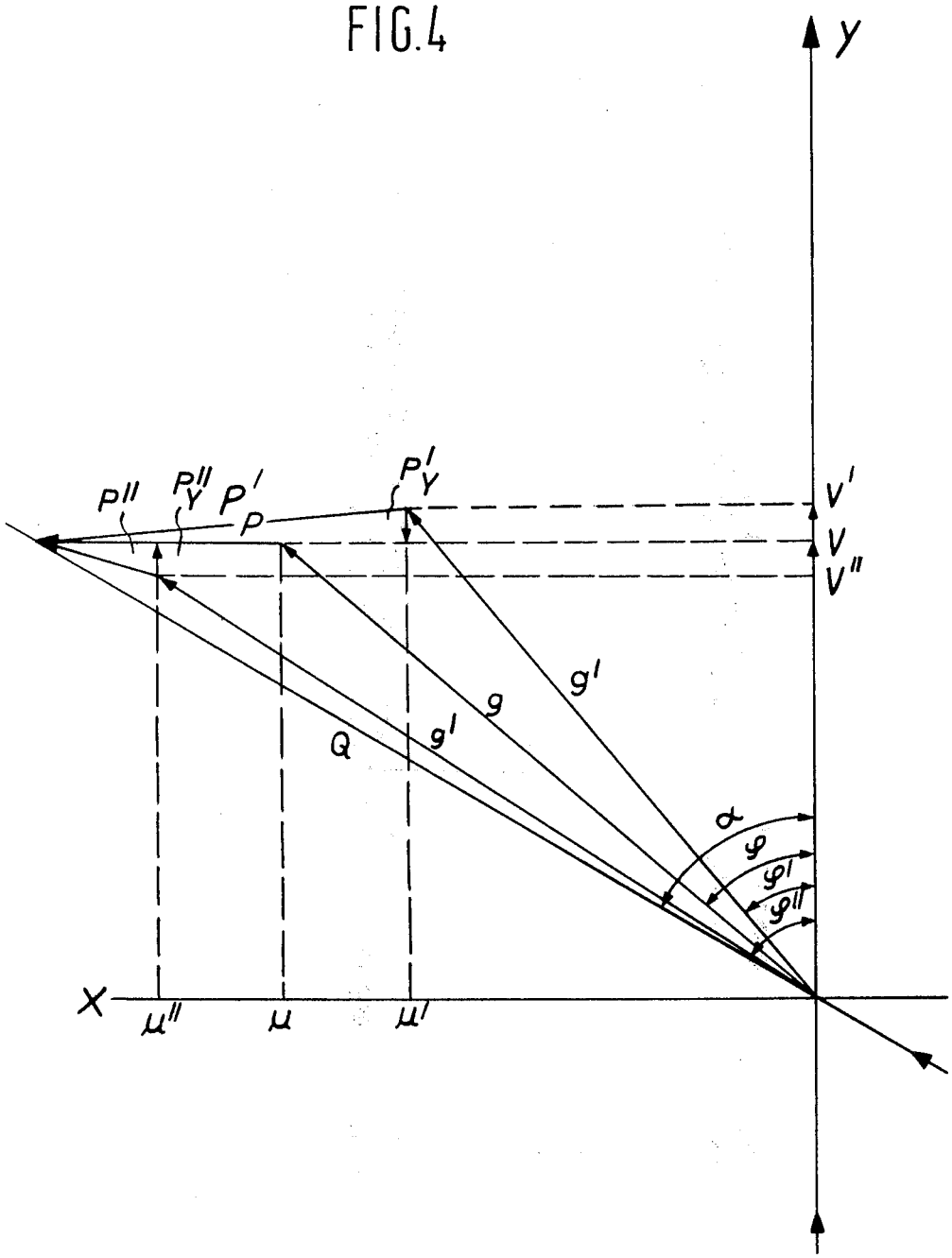
FIG. 4 is a second diagram showing kinematic conditions that arise when imparting friction twist to yarn.

Referring now to FIG. 4 which shows a modification of FIG. 1, again the yarn moves in the Y direction at an axial speed $v$ and has a circumferential speed $u$ in the X direction, which is imparted to the yarn by the friction cylinder. The speeds $v$ and $u$ result in a speed $g$ of the yarn surface, the direction of which is inclined with respect to the direction of the movement of the yarn by the yarn twist angle $\phi$.

If the axial speed $v$ of the yarn has reached the value $v'$, then the friction force P' between the friction cylinder and the yarn has a component $P_y'$, which acts against the direction of movement of the yarn and causes the yarn tension $S_2$ of the yarn leaving the friction cylinder to be higher than the yarn tension $S_1$ of the yarn reaching the cylinder. If, however, $v$ has the value V'', then the friction force P'' has a component $P_y''$, which causes the yarn tension $S_2$ to be lower than the yarn tension $S_1$. In the limit case, the friction force P has no component in the direction of yarn movement, i.e. $S_1$ equal $S_2$.

The angle $\alpha$ is constant and chosen so that it is also larger than the yarn twist angle $\phi$ even with the highest twist densities practically used. Advantageously, the values of the angle $\alpha$ lie between 60° and 65°. Thereby, it is assured that, with all twist densities, a certain, but not too large slippage occurs between yarn and friction cylinder, wherefore, the direction of the friction force P is exactly defined and the stability of yarn movement is assured.

With a constant withdrawal speed $V_a$ of the untwisted yarn downstream of the twist imparter, the axial speed of the twist yarn on the twist imparter sinks with increasing twist density. On the other hand, the existance of a tension ratio $S_1 = S_2$ is connected with the condition that $Q.\cos\alpha = v = v_a.\ \beta$, $\beta$ being the ratio between the twisted and the untwisted length of yarn and Q the speed of the surface of the friction element. Consequently, when the two yarn tensions $S_1$ and $S_2$ are equal, the ratio $Q/v_a$ must have a predetermined value which depends on the twist density and which can be determined easily and used in a gauging diagram.

Figure 2:
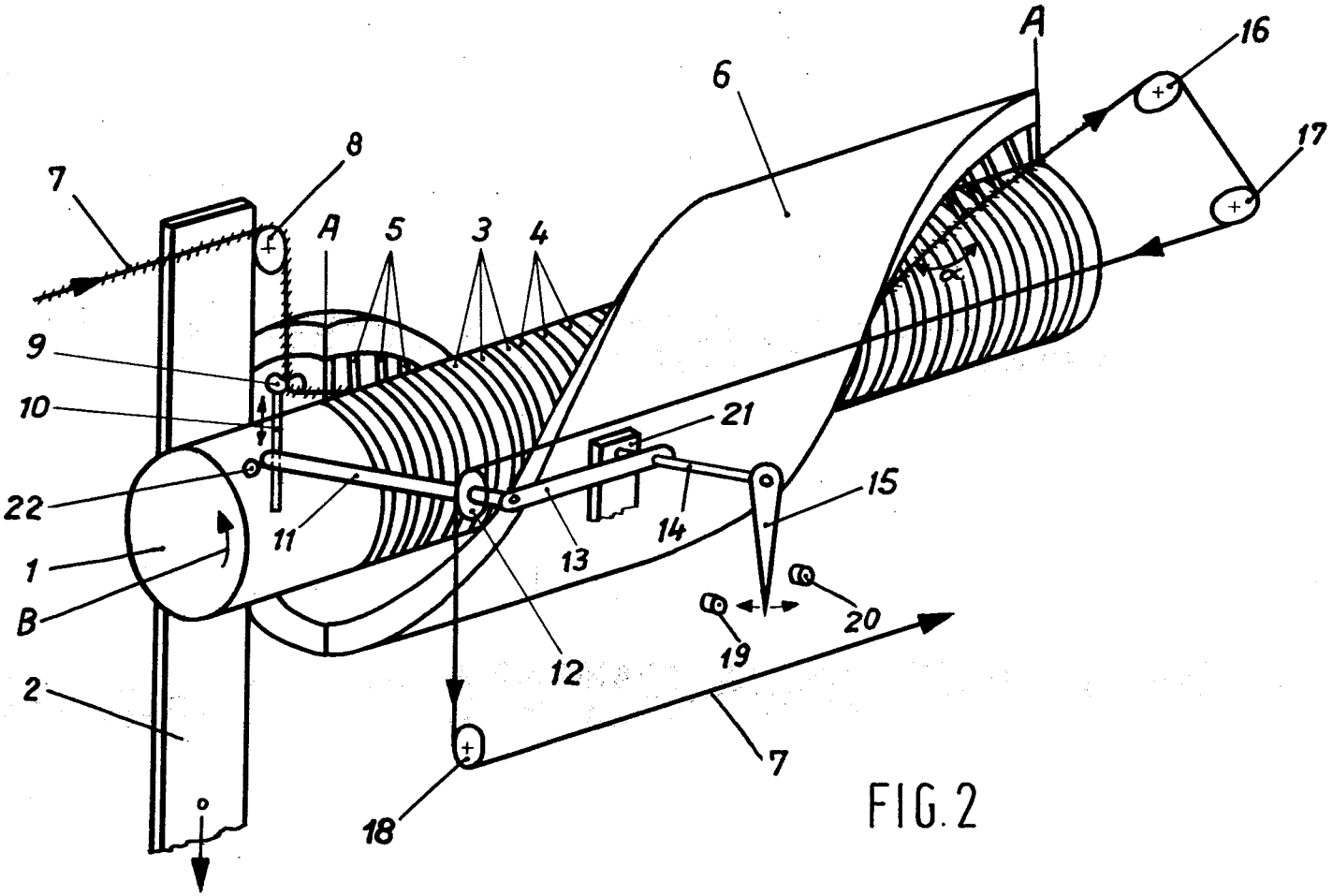
FIG. 2 is a perspective view of apparatus for imparting friction twist to yarn.
Figure 5:
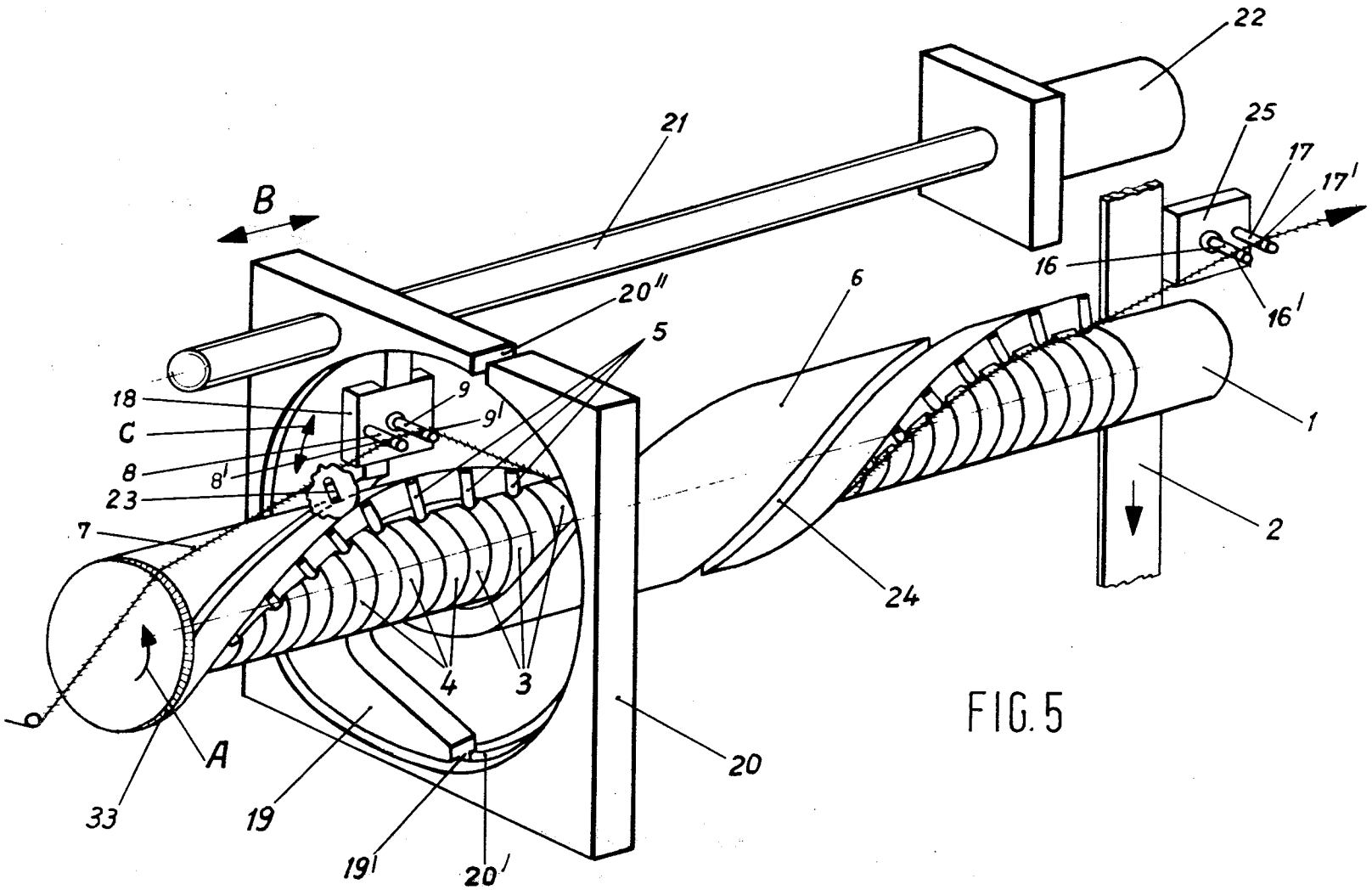
FIG. 5 is a perspective view of a second apparatus for imparting friction twist to yarn.
Figure 6:
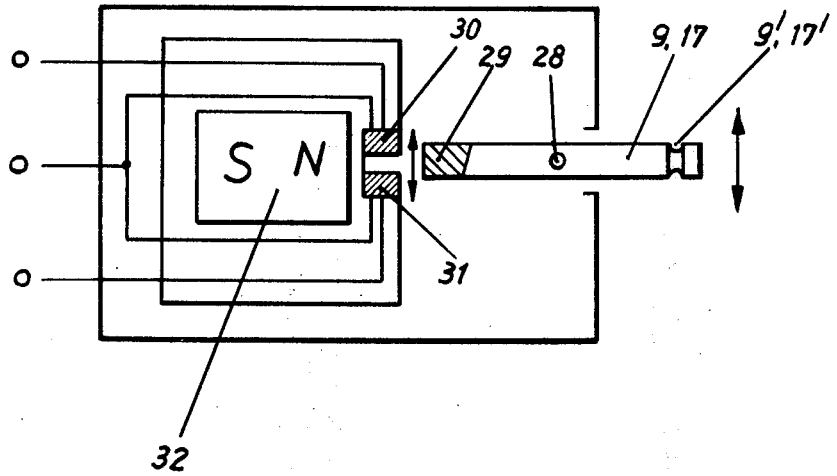
FIG. 6 shows schematically a yarn tension measuring device for the apparatus of FIG. 5.
Figure 7:
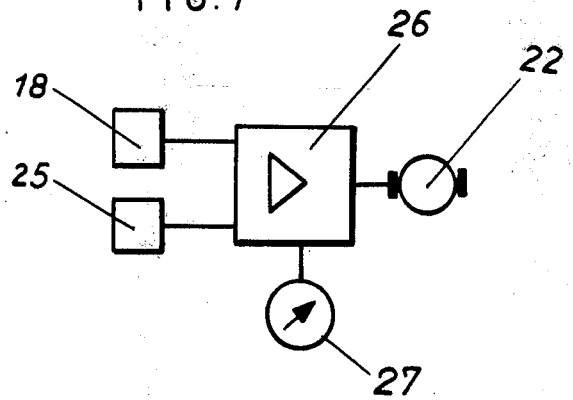
FIG. 7 is a circuit diagram of a tension comparison device of the apparatus of FIG. 5.

A way in which this principle can be applied is by means of the apparatus of FIGS. 5 to 7 wherein the same reference numerals are used for parts that correspond to equivalent parts in the apparatus of FIGS. 2 and 3.

The friction twist imparter consists of a cylinder 1 with a closing plate 33 at the yarn input end of the cylinder, the cylinder being driven at the opposite end by a belt 2 and rotating in direction of arrow A. As in FIG. 2 the portion of cylinder 1 which is in contact with the belt 2 has a smooth surface and the remaining cylinder surface is covered with friction elements 3 advantageously consisting of polyurethane, equidistantly spaced by grooves 4. Also as in FIG. 2, there is a helical support element 6 which carries a series of thread-guides 5 in the form of pins which are arranged radially with respect to the cylinder 1 and enter each of grooves 4. Also the points at which the pins 5 enter the grooves 4 are arranged in a helical curve which is inclined with respect to the grooves at an angle $\alpha$.

The yarn comes from a processing zone (not shown) and moves across the rim of the closing plate 33, a deviating pin 8 and a thread-guide 9 towards the cylinder surface. It then moves around the cylinder 1 in a helical curve which is fixed by the thread-guides 5 and then through a thread-guide 16 and a deviating pin 17, towards delivery rollers (not shown).

The deviating pin 8 and the thread-guide 9 are fixed on a tension measuring device 18 which is fixed itself on a support 19. The support 19 has the shape of an arcuate member and has, on its outer rim surface, a projection 19' which is in engagement with an annular groove 20' formed in the rim surface of the circular hole in a plate 20. The plate 20 is arranged on a threaded rod 21 extending in parallel with the axis of the cylinder 1 and movable by means of servo motor 22 along the cylinder axis (arrow B). The cylinder 1 and the plate 20 are mutually arranged so that the center of the hole in the plate 20 always lies on the cylinder axis. The plate 20 is provided with a slot 20'' to enable the yarn to be inserted.

On the surface of the support 19, there is fixed a guiding pin 23 which is in engagement with a helical groove 24 in the support element 6. When the plate 20 is moved in the direction of arrow B, the guiding pin 23 is guided in the groove 24, while rotating the support 19 in the direction of arrow C. In this manner when the plate 20 has been fixed in a controlled position, it is assured that the thread-guide 9 takes a position in which the yarn 7 is directly applied to the thread-guides 5.

The thread-guide 16 and the deviating pin 17 are also fixed on a tension measuring device 25, this being however permanently fixed because the yarn always leaves the cylinder surface at the same point. The deviating pins 8 and 17 and the thread-guides 9 and 16 furthermore have, near their ends remote from the measuring device, grooves 8', 16', 9', 17' for receiving the yarn 7.

The yarn tension measuring heads 18 and 25 are so-called field plate differential sensors, each having a feeler shown in FIG. 3, constituted by the rod-shaped thread-guides (9, 16), which is rotatable around the axis of a torsion spring 28 to which the thread-guide is fixed on its longitudinal axis which intersects the torsion spring axis. The end of the thread-guide within the measuring device has a portion 29 of soft magnetic material which is situated opposite two so-called field plates, i.e. induction controlled resistances 30, 31. Close to the field plates 30, 31 there is arranged the permanent magnet 32.

When the machine is in operation, the yarn 7 is carried towards the pins 5 by friction contact with the friction elements 3, the distances between the pins being approximately 0.5 cm so that deflection of the yarn between the pins remains very small and the real yarn path nowhere deviates from the direction of the helical curve by more than ±3°, the helical curve being described by the thread-guides 5. This corresponds to a linear deviation of the yarn from the helical curve of approximately 0.1 cm.

In order to impart a determined twist density to the yarn, the ratio $Q/v_a$ must first be determined. Accordingly, the revolution speed of the friction cylinder is adjusted so that it corresponds to the desired twist density and to the desired yarn removal speed $v_a$. Thereupon, the fixture plate 20 is brought into a position in which the yarn 7 from thread-guide 9 will be wrapped around cylinder 1, on the yarn delivery side, by an angle of approximately 20°. Now, the yarn is inserted into the friction twist imparter and the machine started. The yarn tension $S_2$ on thread-guide 16 thereby becomes essentially higher than the yarn tension $S_1$ on thread-guide 9. By shifting the plate 20 with thread-guide 9 in direction of arrow B, the wrapping of the yarn 7 around cylinder 1 is now increased until the yarn tensions $S_1$ and $S_2$ are equal.

Provided the twist density during running of the machine remains constant, the fixture plate 20 remains in the same position. If, however, for any reasons whatever (for example changes of yarn tension or of the friction coefficient), the twist density changes, then this causes an inequality of the tensions $S_1$ and $S_2$, and thereby a change of the position of the fixture plate 20 until the desired twist density is reached again.

As shown in FIG. 4, the servo motor 22 effecting the adjustment of the fixture plate 20 on the rod 21 is connected with the tension measuring devices 18 and 25 via a difference amplifier 26 and is controlled depending on the difference between yarn tensions $S_1$ and $S_2$ which is continuously signalled by the measuring device 27. It is also possible to effect adjustment of the fixture plate 20 by hand. The determined difference between yarn tensions $S_1$ and $S_2$ can furthermore be used for controlling a yarn control device which cuts the yarn if admissible tension differences are reached or exceeded.

The process and the apparatus have various advantages. Because of the considerable possible variation in the wrapping of the yarn around the friction cylinder, the adjusting range of the twist density is very large, and the maximum twist density is in practice limited only by the angle $\alpha$.

By adjusting a very small wrapping of the yarn around the friction cylinder during the starting phase of the machine and subsequent atomatic adjustment of the wrapping necessary for the chosen twist density, the twist density also remains practically constant when variations of the yarn tension or of the friction coefficient occur, and overtensions of the yarn and therefore yarn breakages caused thereby can be avoided to a great extent by controlling a surveying installation in accordance with the continuous measurement of the ratio of the input and output yarn tensions. Finally, the revolution speeds of the friction cylinder necessary for the desired twist density and the yarn delivery speed can be determined easily by experiments and recorded in a gauging diagram.

A particular advantage of the process and of the apparatus of the present invention consists in that the yarn passes around the twist imparter with a big wrap angle, but in a very slight bend (i.e. along a helical path having a large pitch). Also this leads to very gentle treatment of the yarn by the twist imparter. A similar effect is due to the very low force with which the yarn is pressed against the thread-guides 5. With the device of the present invention, it is possible to texture yarn with speeds of above 1000 m/min.

I claim:

1. Apparatus for texturing textile yarns of thermoplastic material by imparting, by means of friction, false-twist to the yarn, comprising a twist imparter consisting of a cylinder mounted to be rotated about its axis and formed at equidistantly spaced intervals along its peripheral surface with circular grooves and also formed with annular friction surfaces respectively located between each pair of adjacent grooves, means for rotating said cylinder about said axis, a fixed support element extending along and spaced from said cylinder, a series of rod-shaped thread-guides allocated respectively to said grooves and fixed to said support element, said thread-guides being of such length and so positioned on said support element that they project into said grooves at points located on a notional helical curve extending along said cylinder, input guide means including first yarn tension sensing means for directing yarn to one end of said cylinder, output guide means including second yarn tension sensing means for directing yarn output from the other end of said cylinder, said input and output guide means being located for the yarn to bear on at least a portion of said series of thread-guides while contacting said annular friction surfaces along the portion of said cylinder and extending along said portion of said series, and means responsive to said first and second tension sensing means enabling a difference between the input and output yarn tensions to be registered,

2. Apparatus according to claim 1, in which said support element is shaped as a helical member coaxial with said cylinder, the pitch of said helical member corresponding to said notional helical curve.

3. Apparatus according to claim 1, in which said thread-guides in said series thereof and consequently said grooves are so spaced that the yarn extending along said thread-guides and in contact with said friction surfaces at all points deviates from said notional helical curve by less than ±3°.

4. Apparatus according to claim 1, in which said means responsive to said first and second tension sensing means comprises a lever extending parallel to said cylinder, a member pivotable about a fixed axis transverse to said cylinder, said lever being fixed to said member, a pointer on said member, two spaced fixed abutments, said pointer being located to travel between said abutments when said member turns about said transverse axis, a shaft fixed transversely to said cylinder on said shaft, at a location remote from said member, a support unit mounted on said shaft, said first tension sensing means being a guide for deviating yarn mounted on said support unit and said second tension sensing means being a guide for deviating yarn mounted on said shaft, whereby a resultant force dependant on the difference between the input and output yarn tensions is applied to said lever.

5. Apparatus according to claim 4, in which said support for said first tension sensing means is adjustably mounted on said shaft by means enabling said support to be located in any one of a range of positions along a line parallel to a line perpendicular to said cylinder axis.

6. Apparatus according to claim 1, comprising a member mounted for adjustment axially along the whole length of said cylinder and circumferentially about said cylinder, said input guide means being mounted on said member.

7. Apparatus according to claim 6, comprising a guide rod mounted parallel to said cylinder, a fixture plate formed with a circular hole through which said support element and said cylinder project centrally with clearance, said fixture plate being movably mounted on said rod, and said member being mounted on said plate to slide round the periphery of said hole about said support element and said cylinder.

8. Apparatus according to claim 1, in which said support element for said series of rod-shaped thread guides is formed with a helical groove extending parallel to said notional helical curve, said apparatus comprising also a guide rod mounted parallel to said cylinder, a fixture plate formed with a circular hole through which said support element and said cylinder project centrally with clearance between the periphery of said hole and said support element, said member being mounted on said fixture plate to said round the periphery of said hole about said support element and said cylinder, a control pin fixed to said member and projecting into said groove, said fixture plate being mounted on said rod to travel along the length of said support element and of said cylinder while said control pin travels along said groove to control the position of said member on said fixture plate circumferentially about said cylinder, and said input guide means being mounted on said member.

9. Apparatus according to claim 8, comprising a servo motor operative to control the position of said fixture plate along the axis of said rod, said means responsive to said first and second tension sensing means being a difference amplifier connected to control said servo motor.

10. A process for texturing textile yarns of thermoplastic material by imparting by means of friction, false-twist to the yarn, comprising the steps of feeding the yarn at a predetermined angle to a point on a cylindrical friction twist imparter surface rotating at a constant speed about its axis, directing the yarn from said point along said surface in contact therewith on a helical path while maintaining the angle between the direction of movement of said surface of said twist imparter and the direction of movement of the yarn along the helical path at a constant value over the whole length of said helical path, said angle being larger than the twist angle imparted to said yarn while passing along said surface, withdrawing the twisted yarn from a second point on said rotating cylindrical twist imparter surface, and controlling the tension of the yarn being fed to said first point in relation to the tension of the yarn being withdrawn from said second point.

11. The process of claim 10, comprising the steps of comparing the tension of the yarn fed to said first point with the tension of the yarn withdrawn at said second point and bringing said two tensions automatically to the same value.

12. The process of claim 10, wherein said angle between the direction of movement of said twist imparter and the direction of the yarn is substantially 60°.

13. The process of claim 10, wherein the yarn is directed along said helical path for a distance such that the yarn travels round said rotating surface through an angle between 200° and 300° inclusive relatively to said surface.

14. The process of claim 10, comprising adjusting the position of said first point whereby the length of yarn in contact with said surface is made longer or shorter according to whether the tension of the yarn approaching said first point is lower or higher than the tension of the yarn withdrawn from said second point.

15. The process according to claim 10, comprising using a thread-guide to direct the yarn to said first point and adjusting the location of said point to provide a desired yarn twist density by moving said thread-guide axially parallel to said cylindrical surface and circumferentially about said cylindrical surface.

16. The process of claim 15, comprising the steps of starting a yarn twisting operation with said thread-guide set for the yarn to be wrapped round said cylindrical surface along said helical path by between 0% and 20% of the complete wrapping of the yarn required for the required twist density and subsequently moving said thread-guide to provide the required twist density.

17. The process according to claim 15, comprising choosing the rotation speed of said cylindrical surface about its axis so that the ratio of the yarn tension on the movable thread-guide and the yarn tension at said second point, in the presence of the desired twist density of the yarn, has a predetermined value.

18. The process according to claim 15, comprising choosing the rotation speed of said cylindrical surface about its axis so that the ratio of the yarn tension on the movable thread-guide and the yarn tension at said second point, in the presence of the required twist density of the yarn, is at least approximately 1 : 1.

19. The process according to claim 15, comprising continuously measuring the ratio of the yarn tension on the movable thread guide and the yarn tension at said second point and modifying the wrapping of the yarn around said cylindrical surface according to each deviation of said ratio from a predetermined value to return said ratio to said predetermined value.

20. The process according to claim 15, comprising continuously measuring the ratio of the yarn tension on the movable thread-guide and the yarn tension at said second point and controlling a yarn surveying installation in accordance with such measurement.

* * * * *